United States Patent [19]

Lundblade et al.

[11] Patent Number: 4,775,072

[45] Date of Patent: Oct. 4, 1988

[54] HANDLE ASSEMBLY FOR INSULATED CONTAINER

[75] Inventors: Gene D. Lundblade, Valley Center; Lauren Worley, Wichita, both of Kans.

[73] Assignee: The Coleman Company, Inc., Wichita, Kans.

[21] Appl. No.: 79,161

[22] Filed: Jul. 29, 1987

[51] Int. Cl.[4] ..... B65D 25/28

[52] U.S. Cl. ..... 220/94 R; 16/112

[58] Field of Search ..... 220/94 R, 71, 83, 444, 220/902; 16/112; 312/320

[56] References Cited

U.S. PATENT DOCUMENTS

| | | | |
|---|---|---|---|
| 2,765,888 | 10/1956 | Finkelstein | 16/112 |
| 3,153,491 | 10/1964 | MacTavish | 220/94 R X |
| 3,933,269 | 1/1976 | Mastrovito | 220/94 R |
| 4,040,695 | 8/1977 | Brann | 16/112 X |
| 4,095,711 | 6/1978 | Conley | 220/94 R |

*Primary Examiner*—Steven M. Pollard

[57] ABSTRACT

An insulated container is provided with a handle assembly which includes a pivoting handle and a reinforcing back-up plate. The container includes an outer casing, an inner liner, and foam insulation between the casing and the liner. The handle is pivotally mounted in a recess in the casing by a pair of support brackets which are positioned in the space between the casing and the liner before the space is filled with foam insulation. Each bracket includes a pin which extends through the wall of the casing into the handle and a reinforcing plate which extends along the inner surface of the casing behind the handle.

7 Claims, 2 Drawing Sheets

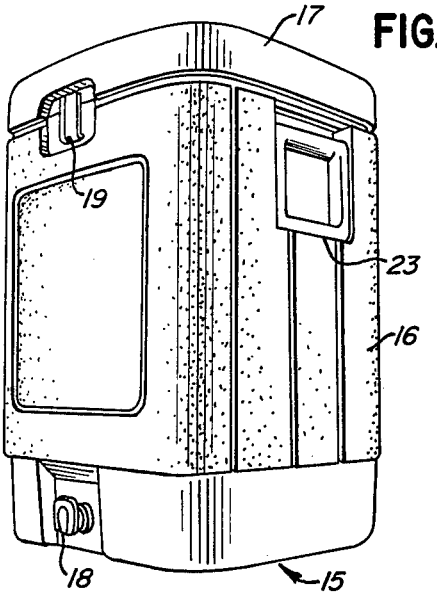
FIG. 1
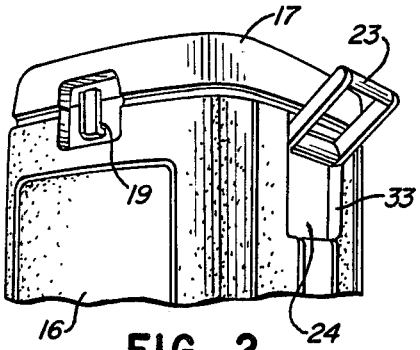
FIG. 2
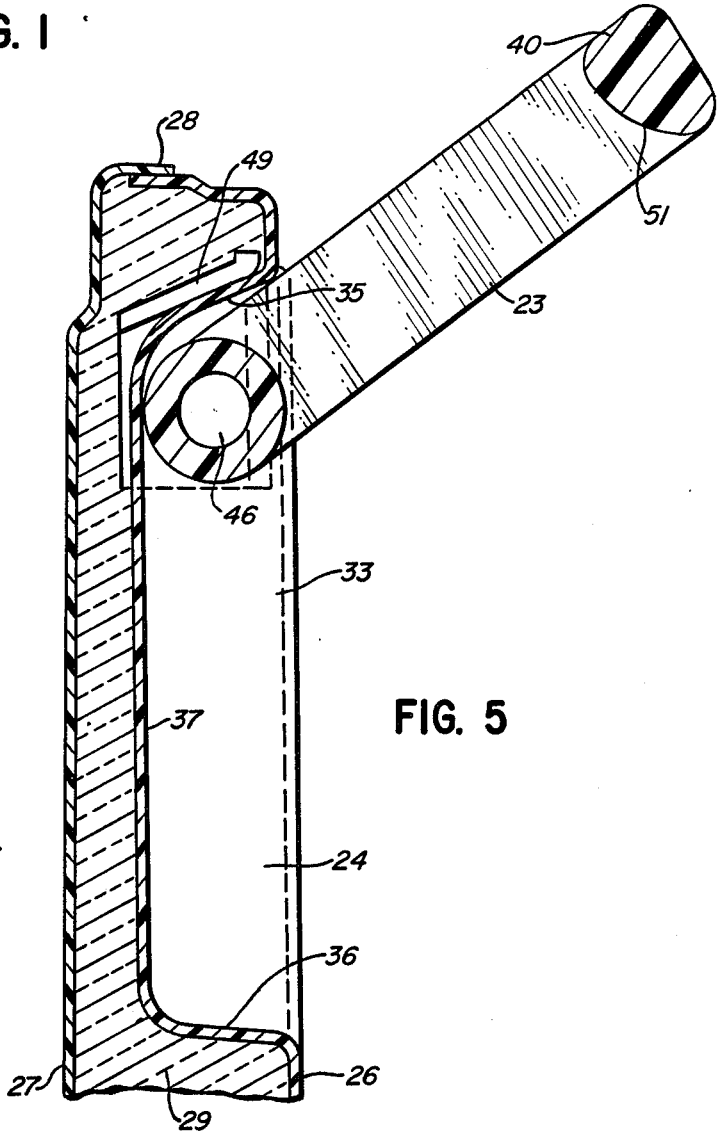
FIG. 5
FIG. 3
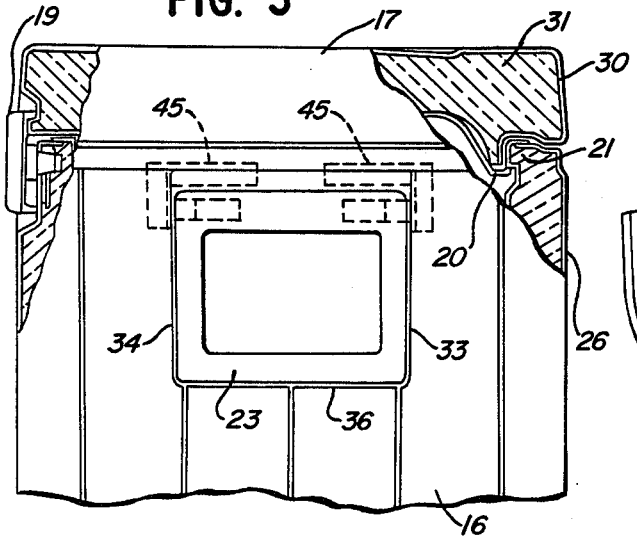
FIG. 4
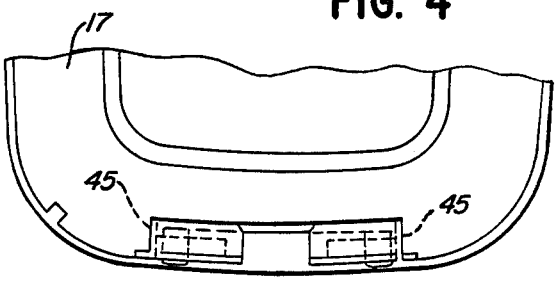

FIG. 8
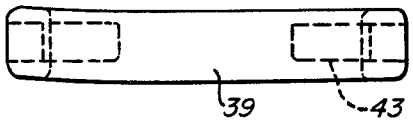
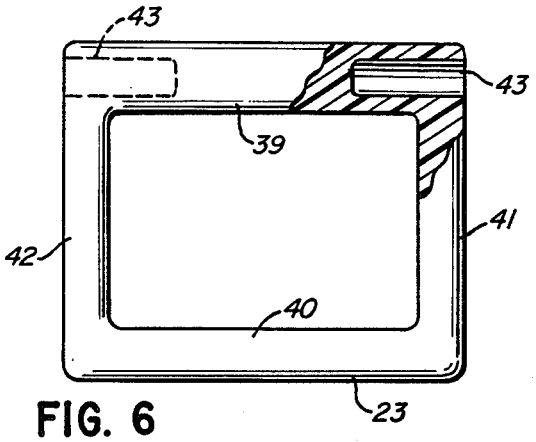
FIG. 6
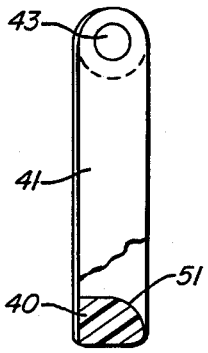
FIG. 7
FIG. 12
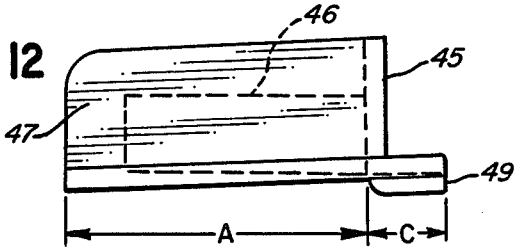
FIG. 9
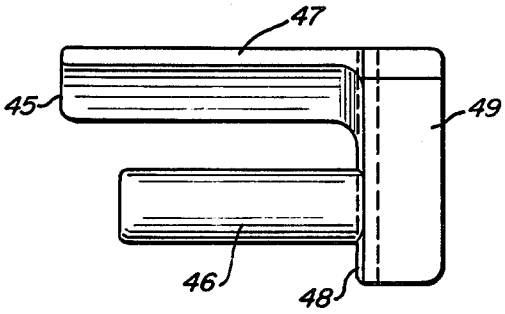
FIG. 10
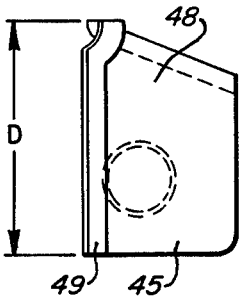
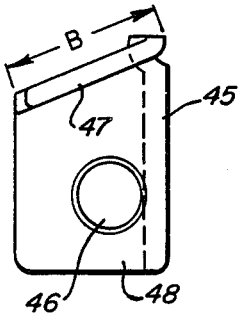
FIG. 11

HANDLE ASSEMBLY FOR INSULATED CONTAINER

BACKGROUND AND SUMMARY

This invention relates to insulated containers such as coolers for water and other beverages, ice chests, etc. More particularly, the invention relates to a handle assembly for an insulated container.

U.S. Pat. No. 4,095,711 describes a picnic cooler with a pair of pivoting handles. The cooler is formed by an outer casing, an inner liner or shell, and foamed insulation which is injected into the space between the casing and the liner. Before the foam is injected, a pair of mounting members are positioned in the space between the casing and the liner and extend through the casing to support pivot pins for the handles. The mounting members are held in place by the foam. More recently, the two mounting members have been joined by a connecting piece which extends between the mounting members in the space between the casing and the liner.

The invention provides a recessed handle assembly in which a pivoting handle is positioned in a recess in the casing so that the handle is flush with the outer surface of the casing. A pair of support brackets for the handle not only pivotally support the handle but also reinforce the casing. The recess in the casing has a pair of side walls and a top wall. Each of the support brackets includes a pin which extends through one of the side walls of the recess in the casing for pivotally supporting the handle and a reinforcing plate. The reinforcing plate extends along the inside surface of the top wall of the recess and reinforces the portions of the top wall which are contacted by the handle when the cooler is lifted. The reinforcing plates also provide substantial surface area for contacting the foam insulation and distributing the lifting force over a substantial area of the foam. The reinforcing plates are therefore maintained in position by the foam and the casing and the foam are not deformed by the lifting force.

DESCRIPTION OF THE DRAWING

The invention will be explained in conjunction with an illustrative embodiment shown in the accompanying drawing, in which FIG. 1 is a perspective view of a cooler which is equipped with handle assemblies in accordance with the invention;

FIG. 2 is a fragmentary perspective view showing one of the handles in a raised position;

FIG. 3 is a fragmentary side elevational view, partially broken away, of the cooler;

FIG. 4 is a fragmentary top plan view of the cooler;

FIG. 5 is a fragmentary sectional view showing one of the handles in the raised position;

FIG. 6 is an elevational view, partially broken away, of one of the handles;

FIG. 7 is a side view, partially broken away, of the handle of FIG. 6;

FIG. 8 is a top plan view of the handle of FIG. 6;

FIG. 9 is an elevational view of one of the support brackets;

FIG. 10 is a right side view of the support bracket of FIG. 9;

FIG. 11 is a left side view of the support bracket of FIG. 9; and

FIG. 12 is a top plan view of the support bracket of FIG. 9.

DESCRIPTION OF SPECIFIC EMBODIMENT

Referring to FIGS. 1–4, the numeral 15 designates generally an insulated cooler which comprises a chest 16 and a lid 17. The particular cooler illustrated is designed to hold water or other beverages and includes a spigot 18 for dispensing the contents of the cooler. It will be understood, however, that the invention can be utilized with other types and shapes of coolers, for example, picnic coolers, ice chests, etc.

The front of the lid 17 is latched to the top of the chest 16 by a rotating latch 19 which is mounted on the chest. The rear of the lid is provided with a projection 20 (FIG. 3) which engages a shoulder 21. The lid and the latching arrangement do not form any part of the present invention, and the details thereof need not be explained herein.

A handle 23 is pivotally mounted in a recess 24 in the chest for lifting the cooler. An identicial handle is mounted on the opposite side of the cooler. When the handle is in its lowered position illustrated in FIG. 1, it lies completely within the recess and is flush with the outside surface of the chest. When the cooler is to be lifted, the handle pivots upwardly as shown in FIGS. 2 and 5.

The chest 16 which provides the cooling enclosure of the cooler includes an outer plastic shell or casing 26 (FIG. 5) and an inner plastic shell or liner 27. The liner and casing overlap at 28 around the top rim of the chest, and the space between the liner and the casing is filled with insulating plastic foam 29. The foam hardens when it cures and provides the cooler with structural rigidity. In one specific embodiment the casing 26 and the liner 27 were formed from polyethylene, and the foam 29 was polyurethane. The lid 17 similarly includes an outer polyethylene shell 30 and a filler of insulating polyurethane foam 31 (FIG. 3). The construction of coolers with inner and outer shells and foam interiors is well known, and a detailed description is unnecessary.

The recesses 24 for the handles 23 are molded into the outer casing 26. Each recess includes inwardly extending side walls 33 and 34 (FIGS. 3 and 5), top and bottom walls 35 and 36, and a back wall 37 which extends generally parallel to the portion of the casing which surrounds the recess.

Referring to FIGS. 6–8, each handle 23 has the shape of a rectangular loop and includes top and bottom parallel struts 39 and 40 and side parallel struts 41 and 42. Counterbores 43 extend inwardly from both ends of the top strut 39. The handle is advantageously molded from polypropylene.

Each handle 23 is pivotally supported within a recess 24 by a pair of support brackets 45 (FIGS. 9–12). The support bracket includes a pin 46 which is designed to be inserted into one of the bores 43 in the handle and a reinforcing or backup plate 47 which overlies the top wall 35 of the recess as shown in FIG. 5. The reinforcing plate is generally planar and extends parallel to the axis of the pin 46. Both the reinforcing plate and the pin extend from a flat connecting plate 48 which extends perpendicularly to the axis of the pin. A front reinforcing plate 49 extends from the front edge of the connecting portion in a plane which is parallel to the axis of the pin. The particular support bracket illustrated was molded from polypropylene.

After the outer casing 26 is molded and before the casing and the inner liner 27 are assembled, a hole is drilled in each of the side walls 33 and 34 of each of the handle recesses 24. A handle 23 is positioned in the recess and is supported by inserting the pin 46 of a support bracket 45 through the hole in the side wall from the inside surface of the casing. The spacing of the opening from the top wall 35 of the recess is such that the reinforcing plate 47 of the support bracket extends along the inside surface of the top wall 35 as shown in FIG. 5. The front reinforcing plate 49 extends along the inside surface of the casing adjacent the side wall of the recess. The connecting portion 48 extends along the inner surface of the side wall of the recess.

After the handles are mounted in both recesses, the inner liner 27 is joined to the outer casing 26, and the foam filler 29 is injected into the space between the casing and the liner. When the foam cures, the foam holds the support brackets 45 in place and prevents the handle assemblies from coming apart.

Each of the handles pivots between a lowered position illustrated in FIG. 1 and a raised or lifting position illustrated in FIGS. 2 and 5. When the handle is lowered, it is positioned within the recess 24 and does not extend outwardly beyond the outer surface of the casing 26 which surrounds the recess. If desired, the width of the handle and the spacing between the side walls 33 and 34 of the recess can be selected to provide an interference fit when the handle is lowered, thereby preventing the handle from swinging out of the recess inadvertently.

The cooler is lifted by grasping the bottom strut 40 of each handle and pivoting the handle out of the recess. The bottom strut is provided with a curved surface 51 (FIGS. 5 and 7) which facilitates pivoting the handle out of the recess. The handle swings upwardly until it engages the top wall 35 of the recess as illustrated in FIG. 5. The lifting force exerted on the handle is thereby transferred to the cooler through the top wall 35 and the pins 46 of the support bracket 45, and the cooler is lifted.

The contact between the side struts 41 and 42 of the handle and the top wall 35 of the recess occurs over a relatively small area. The weight of the cooler can therefore exert a substantial pressure on the portion of the top wall 35 which is contacted by the handle. Without the reinforcing plate 47, such pressure could deform the molded plastic casing 26 and the foam insulation 29 and ultimately cause failure. However, the reinforcing plate 47 inhibits deformation of the top wall 35 and extends along a substantial portion of the top wall to distribute the force on the top wall over a substantial area of the insulating foam. The pressure on the insulating foam is thereby reduced to a level which it can withstand without deforming. The area of the front reinforcing plate 49 also helps to distribute force over the insulating foam and reduce the pressure on the foam. The weight of the cooler which is exerted on each of the pins 46 is transmitted to the insulating foam by the connecting plate 48 and the two reinforcing plates 47 and 49.

In one specific embodiment of a ten gallon cooler, the reinforcing plate 47 had a length dimension A (FIG. 12) of about 2-inches and a width dimension B (FIG. 11) of about 1-1/16 inches. The front reinforcing plate 49 had a length dimension C (FIG. 12) of about 0.52 inch and a height D (FIG. 10 of about 1.54 inches.

The invention permits the handles of an insulated plastic cooler to be mounted within recesses in the plastic outer casing. Even though the handles engage a relatively small area of the casing when the cooler is lifted, the casing is reinforced and the weight of the cooler is distributed over a substantially greater area of the insulating foam by unique support brackets. The casing and the insulating foam are thereby permitted to withstand repeated lifting forces without permanent deformation.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A handle assembly for an insulated container having an outer casing, and inner liner, and foam insulation between the casing and the liner, the casing having an outer surface and a recess extending inwardly from the outer surface, the recess having a back wall, a pair of side walls, and a top wall extending from the back wall to the outer surface of the casing, the handle assembly including:

a pair of handle support brackets, each of the brackets including a pin which extends through an opening in one of the side walls of the recess in the casing and a reinforcing plate which extends along the inner surface of the top wall of the recess, and a handle pivotally supported within the recess by the pins.

2. The handle assembly of claim 1 in which the handle is generally rectangular and includes a pair of side struts and top and bottom struts extending between the side struts, said pins extending into said top strut, the handle being pivotable between a lowered position in which the handle is positioned within the recess in the casing and a raised position in which the side struts engage the top wall of the recess.

3. The handle assembly of claim 1 in which each of the handle support brackets is retained in position by the foam insulation.

4. The handle assembly of claim 1 in which the reinforcing plate extends in a plane which is parallel to the axis of the pin.

5. The handle assembly of claim 1 in which each of the handle support brackets includes a connecting portion which extends between the pin and the reinforcing plate alongside the inner surface of one of the side walls of the recess in the casing.

6. The handle assembly of claim 5 in which the connecting portion extends perpendicuarly to the axis of the pin.

7. The handle assembly of claim 5 in which each of the handle support brackets includes a front reinforcing plate which extends along the inside of the casing adjacent one of the side walls of the recess.

* * * * *